United States Patent [19]

Reismann et al.

[11] Patent Number: 4,866,969

[45] Date of Patent: Sep. 19, 1989

[54] THREE-PART ROLL ASSEMBLY WITH EXCHANGEABLE CENTER PART

[75] Inventors: Hans-Jürgen Reismann, Düsseldorf; Alexandr Svagr, Hilden, both of Fed. Rep. of Germany

[73] Assignee: SMS Schloemann-Siemag Aktiengesellschaft, Dusseldorf, Fed. Rep. of Germany

[21] Appl. No.: 256,350

[22] Filed: Oct. 11, 1988

Related U.S. Application Data

[63] Continuation-in-part of Ser. No. 905,271, Sep. 8, 1986, abandoned.

[30] Foreign Application Priority Data

Sep. 6, 1985 [DE] Fed. Rep. of Germany ..... 3531843
Oct. 16, 1987 [DE] Fed. Rep. of Germany ..... 3735098

[51] Int. Cl.[4] ..... B21B 27/02; B21B 31/08

[52] U.S. Cl. ..... 72/238; 29/121.5; 29/123; 29/125; 29/129

[58] Field of Search ..... 72/237, 238, 239, 245; 29/121.1, 121.5, 121.6, 123, 124, 125, 129, 129.5

[56] References Cited

U.S. PATENT DOCUMENTS

| | | | |
|---|---|---|---|
| 3,433,045 | 3/1969 | Wilson | 29/129 X |
| 3,628,366 | 12/1971 | Leitner | 72/239 |
| 3,737,962 | 6/1973 | Hill | 29/123 |
| 3,833,982 | 9/1974 | Paulin | 29/125 X |
| 3,866,283 | 2/1975 | Gould | 72/238 X |
| 4,021,900 | 5/1977 | Gibson et al. | 72/238 X |
| 4,114,416 | 9/1978 | Bier et al. | 72/238 |
| 4,494,284 | 1/1985 | Post | 29/123 |
| 4,653,304 | 3/1987 | Feldmann et al. | 72/239 |

FOREIGN PATENT DOCUMENTS

| | | | |
|---|---|---|---|
| 1146467 | 4/1963 | Fed. Rep. of Germany | 72/238 |

*Primary Examiner*—Robert L. Spruill
*Assistant Examiner*—Steven B. Katz
*Attorney, Agent, or Firm*—Herbert Dubno

[57] ABSTRACT

A roll assembly for a rolling-mill stand has a pair of axis-defining, coaxial, and axially spaced journals, respective roll supports carried in the journals and rotatable therein about the axis, and a roll ring engaged between the supports. The roll supports are each formed with a pair of radially spaced and separate annular surfaces both centered on the axis and the surfaces of one support are directed at least generally axially toward the other roll support. At least one of the surfaces of each pair is substantially frustoconical and forms with the axis a different angle from the other of the surfaces of the pair. One of the supports is formed at the axis with an axially extending passage and the roll ring is formed with generally axially oppositely directed pairs of annular surfaces respectively complementary to and flatly engaging the annular surfaces of the roll supports. An extension stem axially fixed to the other of the supports extends with radial play through the passage and is provided with a nut or the like bearing on the one element, normally the service-side element, for pulling the two support elements axially toward each other and thereby axially compressing the roll ring between the annular surfaces of the roll supports.

15 Claims, 7 Drawing Sheets

THREE-PART ROLL ASSEMBLY WITH EXCHANGEABLE CENTER PART

CROSS-REFERENCE TO RELATED APPLICATION

This application is a continuation-in-part of our copending patent application Ser. No. 905,271 filed Sept. 08, 1986 now abandoned.

FIELD OF THE INVENTION

Our present invention relates to a rolling-mill stand. More particularly this invention concerns a roll assembly comprised of a two roll-holding elements and a replaceable and exchangeble roll ring between them used for the rolling of steel or other metals.

BACKGROUND OF THE INVENTION

A roll assembly for a rolling-mill stand typically comprises a pair of axis-defining, coaxial, and axially spaced journals, respective roll supports carried in the journals, rotatable therein about the axis, and having confronting annular surfaces centered on the axis, and a roll ring centered on the axis and engaged between the annular surfaces. The service-side support forms on the axis an axially extending passage and an extension axially fixed to the drive-side support extends with radial play through the passage so as to be able to pull the two supports axially toward each other and thereby axially compress the roll ring between the annular sufaces. The drive side of the roll stand, that is the housing parts carrying the drive-side journal is normally stationary, but the opposite service-side journal block and associated housing parts are normally displaceable so that they can be moved out of the way and the roll can be pulled for refinishing and/or replacement.

Such a system has the considerable advantage that the most wear-prone of the element, the ring, can be replaced. The supports riding in the journals can be used with rings of different sizes and can have a service life that is many times longer than the service life of the workpiece-engaging central ring.

Such roll assemblies are described in German patent document Nos. 1,140,535, 1,146,467, 1,602,086, and 132,726 and in U.S. Pat. No. 4,653,304. In these arrangements the two holder parts have axially confronting parts formed with interengaging teeth that rotationally couple them. These teeth have some axial play so that they do not impede clamping of the wear ring between the holding elements.

As a rule one or both of the holding elements is formed with a cylindrical projection that fits within a complementary recess on the ring to center the ring on the holding elements, and it is possible as in U.S. Pat. No. 4,653,304 to provide a morse-taper type of conical interfit to spread the cylindrical part and thereby tighten it in the wear ring. In other arrangements, for example in German No. 1,602,086, frustoconical formations are used to center the ring on the holding elements. When such formations are used there is a problem of metal fatigue in the roll ring. The axial compression necessary to rotationally couple and center the ring must be excessive and normally has a substantial radial component that stretches and that can damage this ring.

OBJECTS OF THE INVENTION

It is therefore an object of the present invention to provide an improved multipart roll assembly.

Another object is the provision of such an improved multipart roll assembly which overcomes the above-given disadvantages, that is which is shaped to ensure accurate centering and solid axial locking of the ring on the elements without substantial deleterious deformation of the ring.

SUMMARY OF THE INVENTION

A roll assembly for a rolling-mill stand according to this invention has a pair of axis-defining, coaxial, and axially spaced journals, respective roll supports carried in the journals and rotatable therein about the axis, and a roll ring engaged between the supports. The roll supports are each formed with a pair of radially spaced and separate annular surfaces both centered on the axis and the surfaces of one support are directed at least generally axially toward the other roll support. At least one of the surfaces of each pair is substantially frustoconical and forms with the axis a different angle from the other of the surfaces of the pair. One of the supports is formed at the axis with an axially extending passage and the roll ring is formed with generally axially oppositely directed pairs of annular surfaces respectively complementary to and flatly engaging the annular surfaces of the roll supports. An extension stem axially fixed to the other of the supports extends with radial play through the passage and is provided with a nut or the like bearing on the one element, normally the service-side element, for pulling the two support elements axially toward each other and thereby axially compressing the roll ring between the annular surfaces of the roll supports.

According to this invention each surface pair includes an inner surface relatively close to the axis and an outer surface relative far from the axis and the inner surface forms with the axis a smaller angle than the respective outer surface. In addition normally the inner surface forms an angle of about 0° to the axis and the outer surface an angle of about 90°.

Thus this system uses the inner surfaces for centering and the outer surfaces for axial clamping. Some deformation can be tolerated in the inner regions of the elements or ring without affecting the workpiece, but at the critical outer region the compression is wholly axial and can be substantial to ensure that the roll assembly of this invention works virtually like a one-piece roll.

According to another feature of this invention the outer surface extends to the outer periphery of the respective element. Furthermore the outer surface of each element can in fact have an apex angle open toward the other element. In this case the elements are formed with relatively narrow flanges forming the outer surfaces and the tightening elements axially draws the supports together with sufficient force that these flanges are elastically deflected away from each other. With this arrangement also the angle of the inner surfaces is and the dimensions of the elements are such that the inner surfaces engage one another only after the outer surfaces engage and the flanges deform. This ensures accurate centering and solid clamping action.

To augment angular force transmission in the assembly of this invention axially interengaging coupling formations are provided on the elements. These coupling formations can be provided axially between the elements and radially within the ring. They can also be on a coupling sleeve formed at its end with coupling formations axially engaged in the coupling formations of the support elements.

A nut on the extension normally serves for tightening the assembly axially together, and a sleeve separate from the one element can be braced axially between the nut and the one element when the system is to be used with a very narrow, that is axially short, ring.

The roll assembly of this invention can also be provided with an annular disk carried on each element and forming the respective surfaces. This allows the most wear-prone portion of the support hubs to be replaced easily. This adjustability can also be achieved by providing spacer rings between the surfaces of the roll ring and the surfaces of the elements.

According to another feature of this invention the extension is a stem axially traversing with play both elements and is provided at each end with a nut constituting part of the means. The nuts are sufficiently tightened to radially swell the respective elements and seize same tightly in the respective journals. In addition in this case the stem is formed with conical threads carrying the nuts. Such conical threads can provide a high-degree of prestressing that can be readily tightened and loosened.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
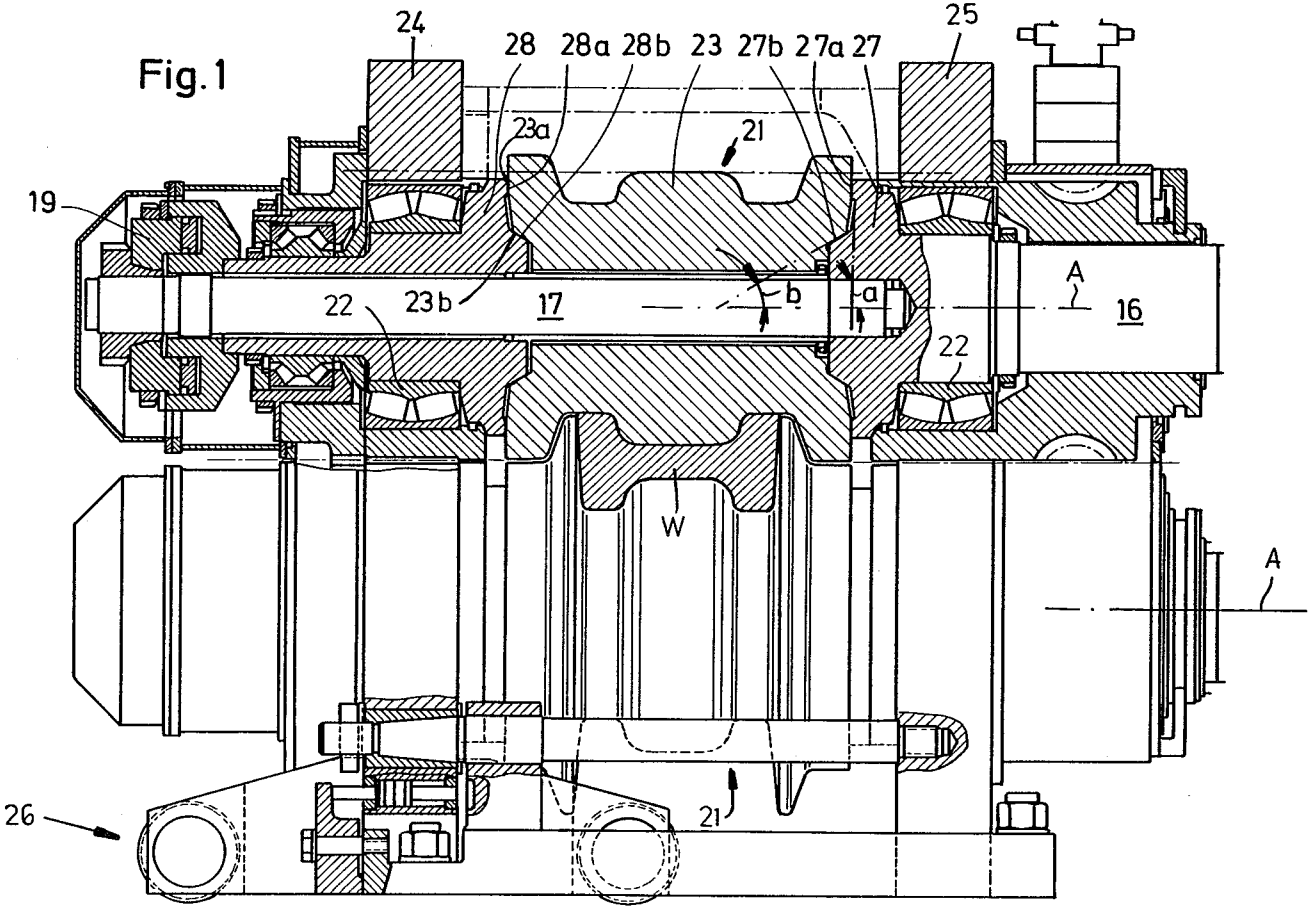
FIG. 1 is an axially section through of a rolling stand according to our invention.

As seen in FIG. 1 a roll stand has a pair of complementary but otherwise substantially identical working rolls 21 centered on parallel axes A and carried in journal blocks 22 in a frame 24, 25 having a drive-side part 24 and a service side 25, the latter being mounted on a carriage 26 so it is movable to remove and work on the rolls 21 and 22. The journal blocks 23 consist basically of large barrel-type roller bearings.

Each roller 1 and 2 is formed of a center ring part 23 centered on the respective axis A and flanked by a pair of holder elements 27 and 28 both also centered on the respective axis A. The ring 23, which itself is what contacts the workpiece W, is formed on the axis with a centered cylindrical passage, and the service-side holder element 28 is also formed with such a passage. A stem or extension 17 has a drive-side end fixed in the element 27 and extends through the aligned passages to a service-side hydraulic nut 19 that itself is also braced against the service-side end of the element 28. The other side of the element 27 is extended at 16 for connection to the drive for the roll stand.

According to this invention each of the elements 27 and 28 is formed with an outer frustoconical surface **27*a* and 28*a* and with an inner frustoconical surface 27*b* and 28*b*. The former forms with the axis A an angle a that is close to 90° and the latter an angle b that is much closer to 45°. The ring 23 is formed with inner and outer surfaces 23*a* and 23*b* that flatly abut the respective inner and outer surfaces 27*a*, 28*a* and 27*b*, 28*b*. With this system, therefore, the outer surfaces 23*a*, 27*a*, and 28*a* serve to axially clamp the ring 23 between the elements 27 and 28. Since they are essentially perpendicular to the axis A they can be used to bring relatively great force to bear without significantly radially stressing the ring 23. On the other hand the inner surfaces 23*b*, 27*b*, and 28*b* serve mainly to center the ring 23 on the mount 27 and 28. Since these surfaces are well inside the various parts, any radial deformation will be relatively inconsequential and will not be reflected in a workpiece flaw. The net effect of these two different sets of surfaces at different locations is that the assembly 23, 27, 28 works virtually as a single piece, the angular force transmission is excellent and there is no significant deformation of the ring 23** where it counts.

Figure 2:
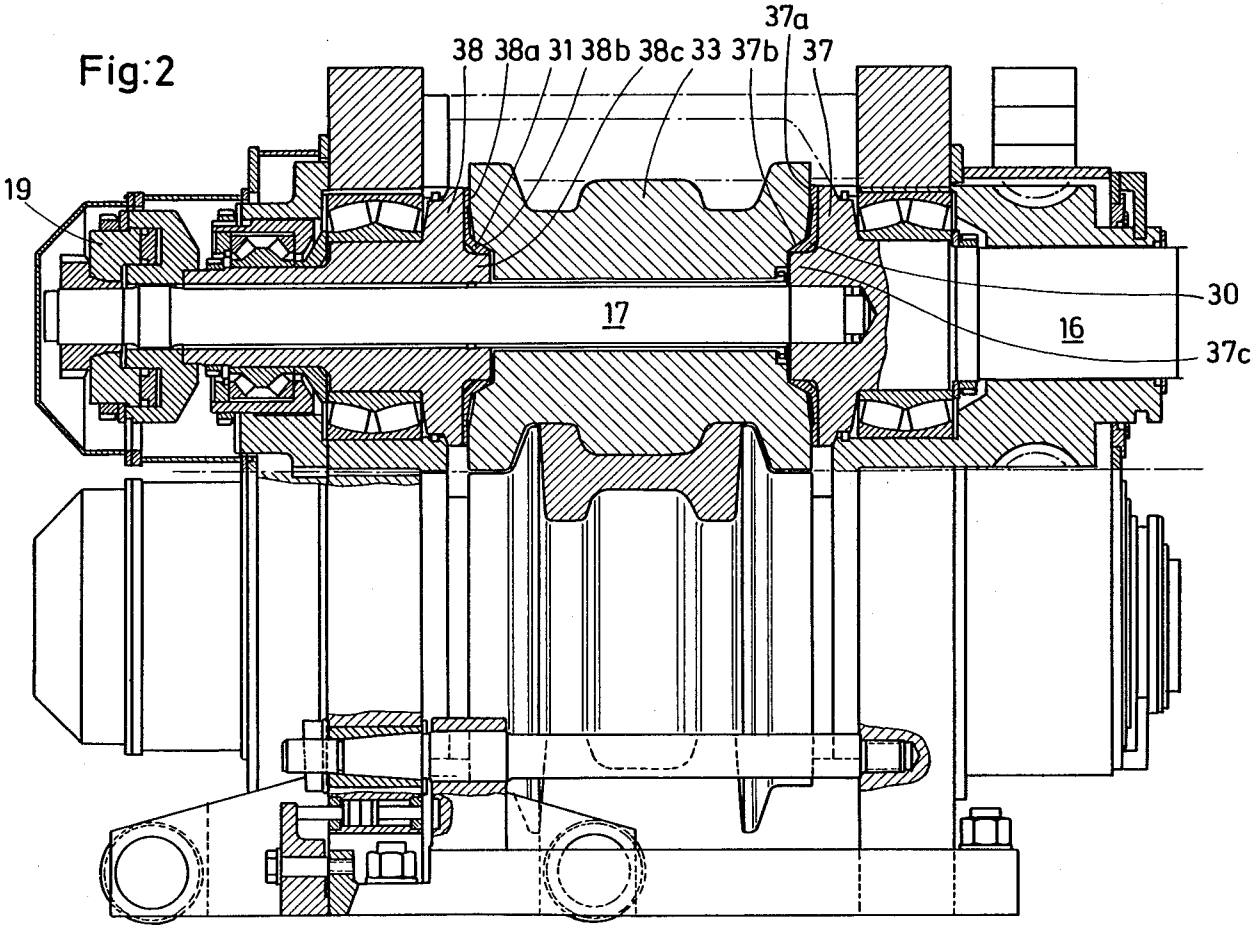
FIG. 2 is a view like FIG. 1 of another embodiment of this invention.

In the system of FIG. 2 substantially the same angular relationships are maintained, but abutment rings 30 and 31 are used with elements 37 and 38 to form surfaces **37*a*, 38*a*, 37*b*, and 38*b* that are functionally and physically identical to surfaces 27*a*, 28*a*, 27*b*, and 28*b*, respectively. In this arrangement the elements 227 and 38 have short cylindrical collars 27*c* and 38*c* on which the rings 30 and 31 fit, but otherwise this structure is identical to that of FIG. 1**.

Figure 3:
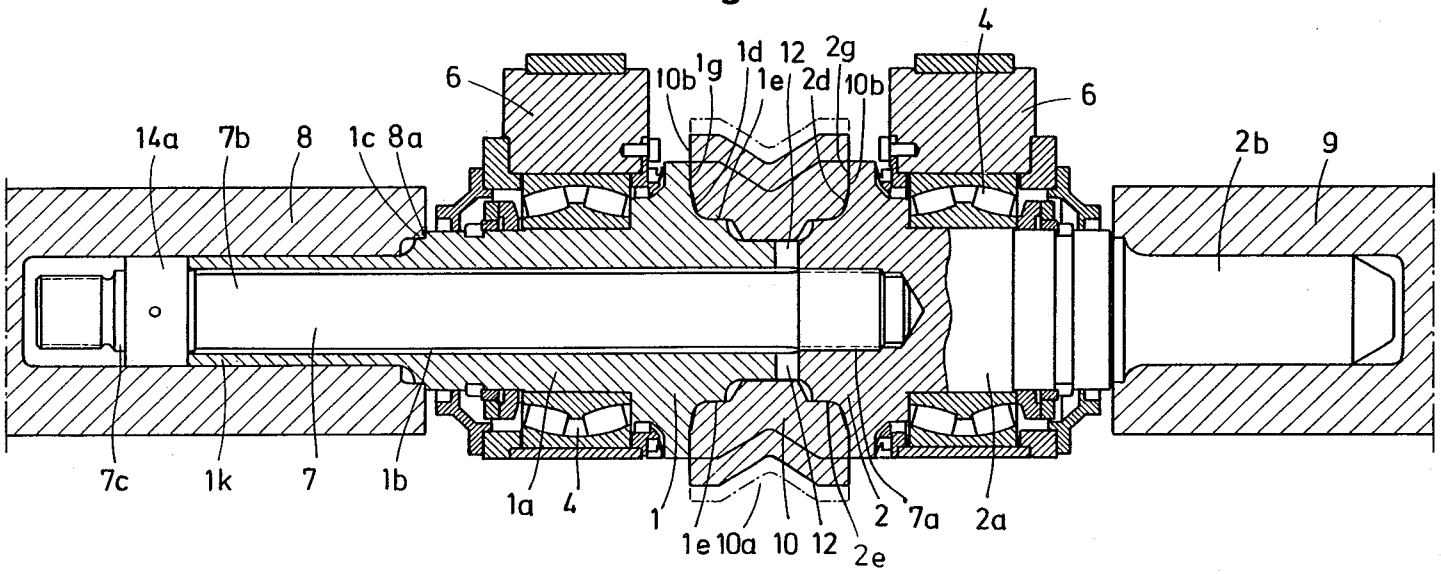
FIG. 3 is an axial section through a roll assembly in accordance with the invention.

In the system of FIG. 3 support elements 1 and 2 have cylindrical extensions **1*a* and 2*a* riding in journal bearings 4 in a roll stand 6 and flank a ring 10. A tension stem 7 has a thread 7*a* engaged in the element 2 and extends out through a passage 1*b* in the part 1, past a sleeve extension 1*k* thereof where it is provided at 7*b* with a nut 14*a* carried on a thread 7*c*. A sleeve 8 fits over the extension 1k at interfitting surfaces and 8*a* and serves to couple this roll assembly with the assembly of an adjacent roll stand. The part 2 has an extension 2*b* that fits in a drive sleeve 9**.

These parts 1 and 2 have confronting annular faces **1*d* and 2*d* each comprising an outer ring surface 1*g*, 2*g*, and an inner ring surface 1*e*, 2*e* and the ring 10 has opposite end faces 10*b* that are complementarily shaped. In this system the two parts 1 and 2 have axially interengaging teeth 12 that insure no angular slip between them and that engage with some axial play but, once rotated against each other, no angular play at all. The outer surface 10*a* of the ring 10** has a V-shaped groove.

Figures 4A, 4B:
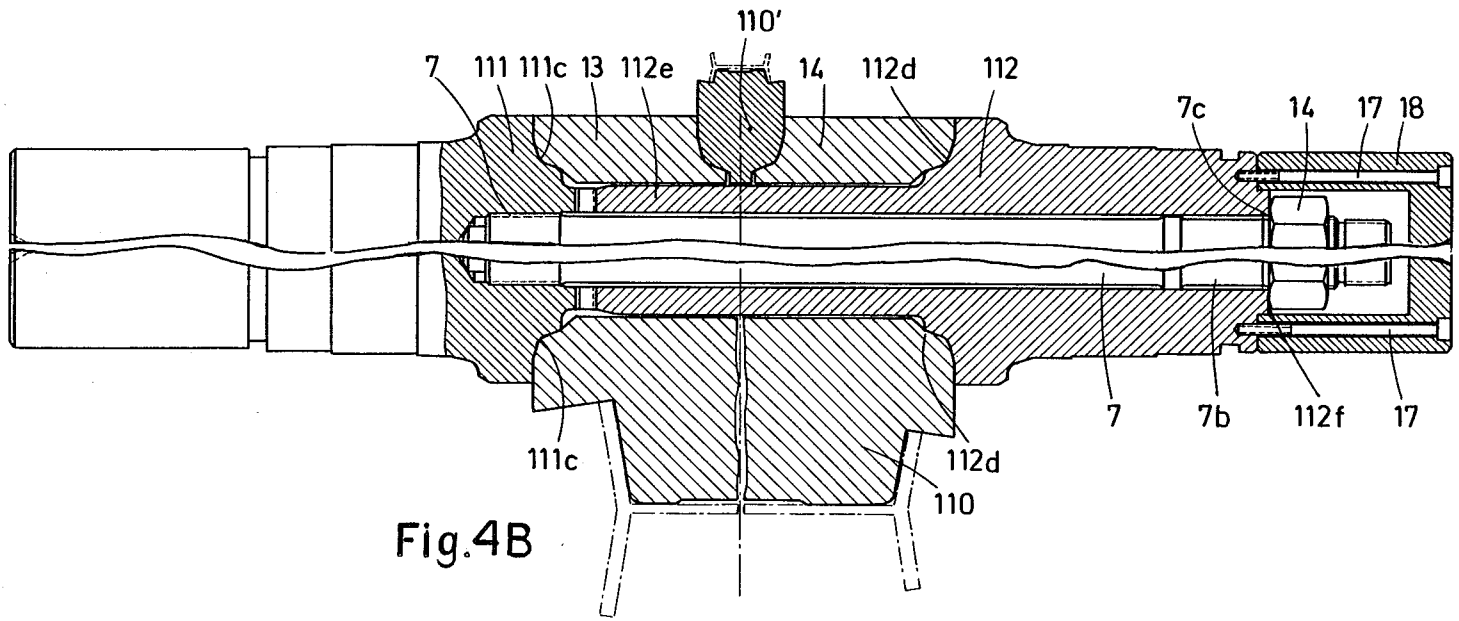
FIGS. 4A and 4B are axial sections through a further roll assembly according to the invention with narrow and wide roll rings.

In FIGS. 4A and 4B two holding elements 11 and 112 are spanned together by a nut 14 as in FIG. 1 carried on a stem 7 and here covered by a cap 18 fixed in place by bolts 17, with the nut 14 carried on threads **7*b* and having a face 7*c* bearing against an end face 112*f* of the part 112**.

This system has faces **111*c* and 112*d* formed by two different surfaces as described above, but that can be used either as shown in FIG. 4*b* to directly engage are relatively wide ring 110, or that can bear by means of appropriately shaped spacer rings 113 and 13 and 14 on a much narrower wear ring 110'. With this system, therefore, it is possible to use the same basic holding elements 111 and 112** for rolling shapes of much different sizes, thereby greatly reducing the setup and retooling costs when workpiece changes.

Figures 5A, 5B:
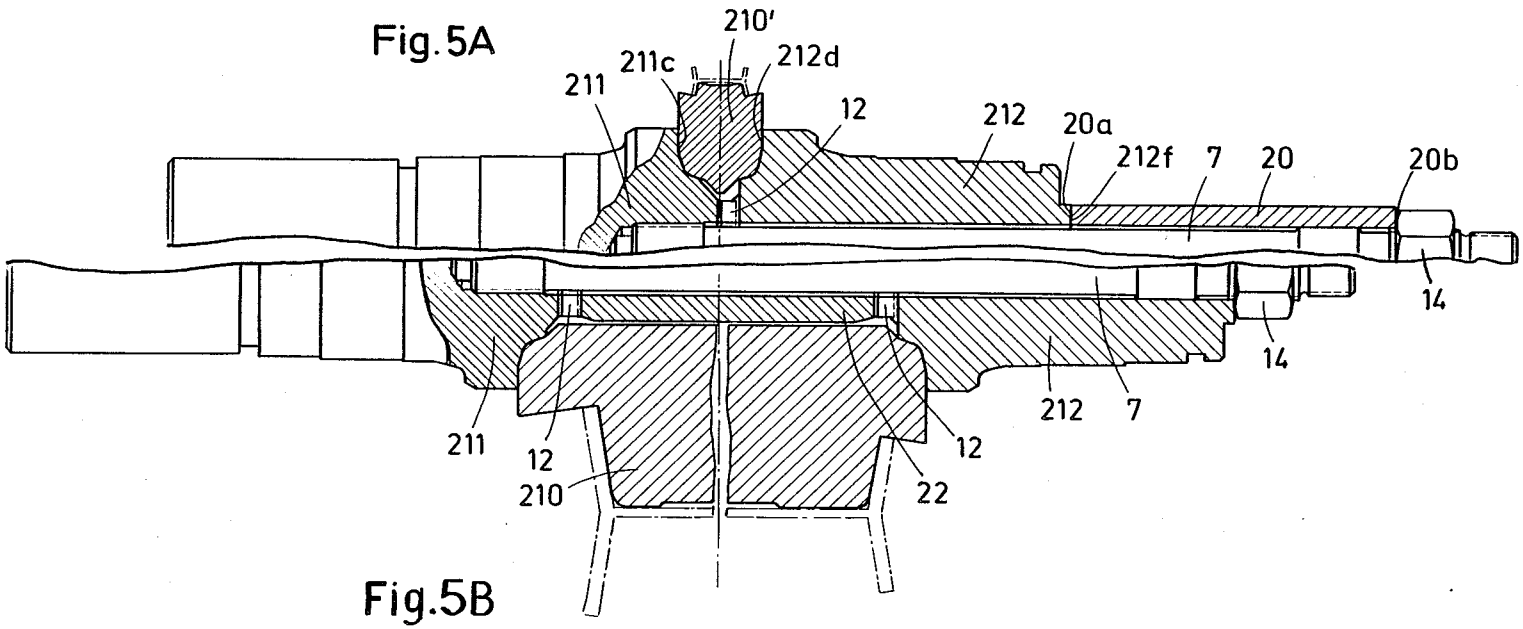
FIGS. 5A and 5B are axial sections like FIGS. 4A and 4B through another roll in two different applications.

FIGS. 5A and 5B show another such adjustable system where the parts 211 and 212 can either be relatively widely spread to accommodate a wide wear ring 210 or relatively close to accommodate a much narrower ring 210'. In both cases, however, the rings 210 and 210' are clamped directly by the element surfaces **211*c* and 212*c*, and the difference in widths is compensated for by use of a spacer sleeve 20 that is used with the narrower ring 210' and that has end surfaces 20*a* and 20*b* that respectively engage the end surface 212*f* of the element 212 and the face of the nut 14. This sleeve 20 is therefore fitted around the stem 7 and only used when a ring is used that is so narrow that the threads of the stem 7 are not sufficient to let the nut 14 be screwed down on the surface 212*f***.

In addition in this system the sleeve 20 is used with a rotation-coupling sleeve 22 that also fits over the stem 7, but between the two parts 211 and 212 and that has on its axially opposite ends teeth 12 that engage with the teeth 12 that normally directly engage each other when used with a narrow ring 210' as shown in FIG. 5A. According to the invention these teeth 12 fit with axial play at all times, and the angular play is taken up with the first relative angular displacement and is thereafter null.

Figure 6:
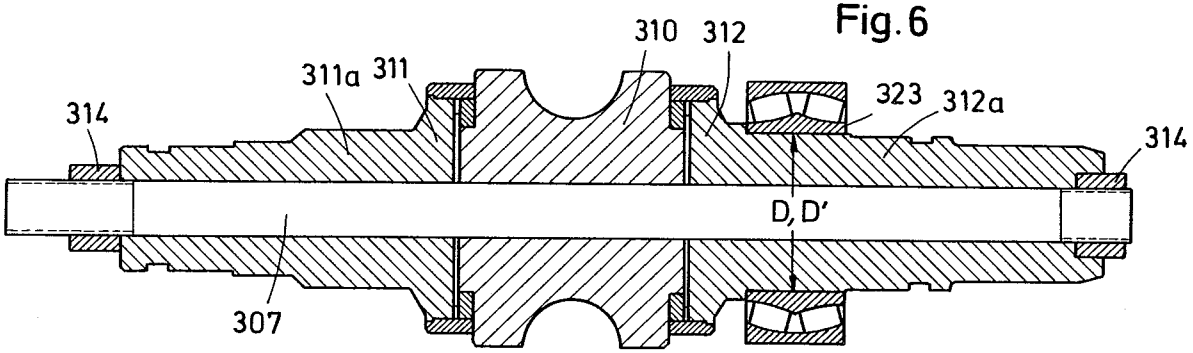
FIGS. 6 and 7 are axial sections through two more rolls according to the invention.

In the arrangement of FIG. 6 two coupling rings 311 and 312 flank a roll ring 312 and are spanned against it by a tension rod 307 which has nuts 314 on both ends. This arrangement makes it possible to set the diameters D of the two cylindrical extensions the journals 323 to be substantially equal to the journal inner diameter. Tightening the nuts 314 slightly spreads these diameters to D', which axially locks these parts 311 and 212 in the inner races of the respective journals 323.

Figure 7:
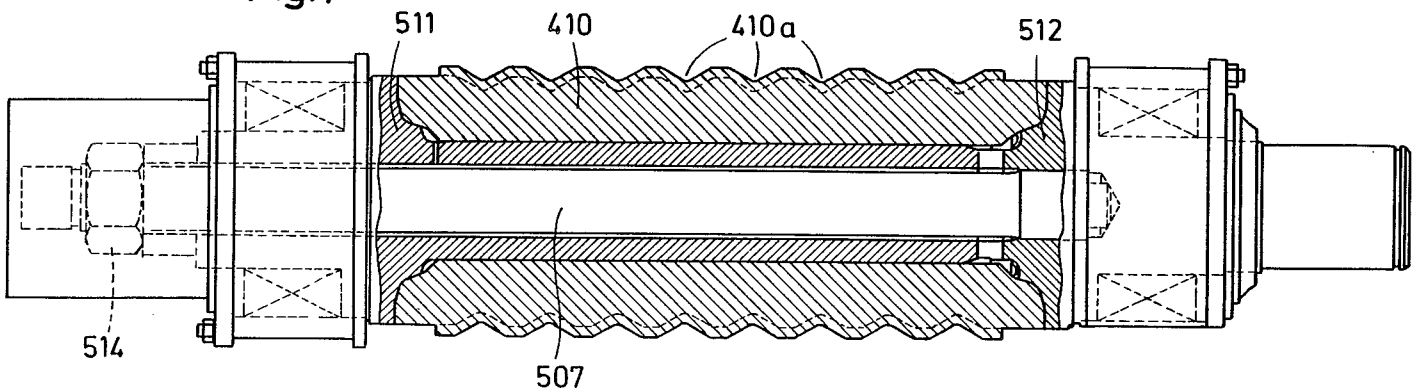

The system of FIG. 7 has a pair of coupling element 511 and 512 that are clamped on a ring 410 by means of a nut 514. Here the outer surface of this ring 410 is formed with a multiplicity of grooves **410*a* for making corrugated sheet metal or the like, but otherwise this system is clamped as in FIG. 1**.

Figure 8:
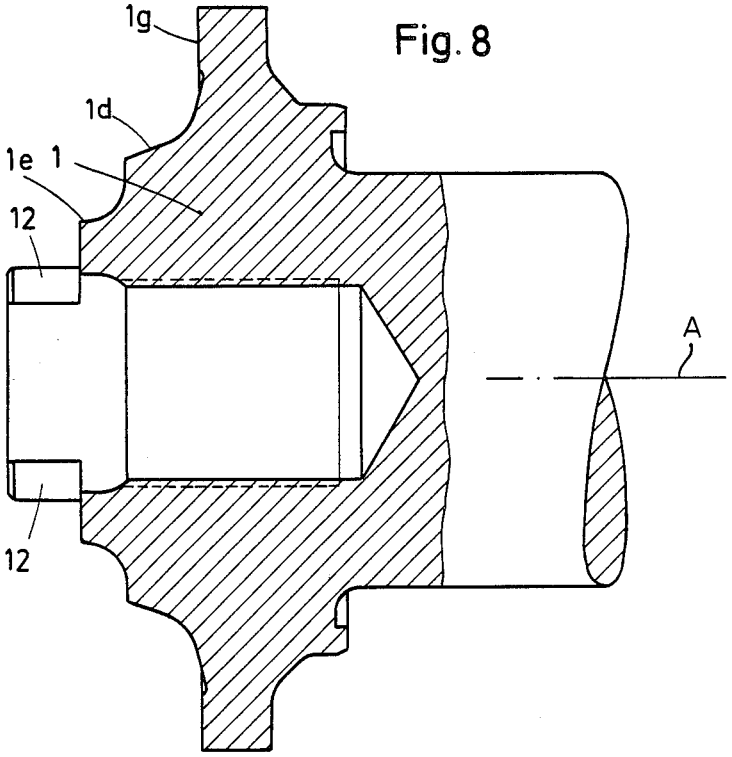
FIG. 8 is an axial section through a support element according to the invention.
Figure 9:
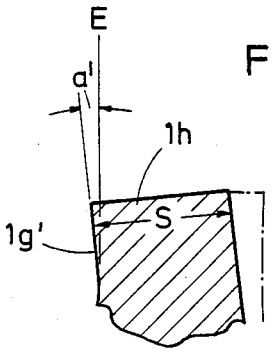
FIG. 9 is a large-scale view of a detail of the support of FIG. 8.

FIG. 8 shows an element 1 as in FIG. 3 whose surface 1g is in a plane perpendicular to the axis A. In addition the surface **1*e* is essentially cylindrical, so that the ring in this case must be heated and then shrunk in place on it. It is also possible as shown in FIG. 9 to make the flange 1*h* forming the outer surface 1g' of a relatively narrow thickness S and to tip it inward so that it extends at an angle a' to a plane E perpendicular to the axis A. This flange 1h is deflected backward until the surface 1g'** is parallel to the plane E when the assembly is completely together or more likely is still inclined somewhat inward, that is with its apex angle open toward the other element. This elastically prestresses the roll assembly together.

We claim:

1. A roll assembly for a rolling-mill stand, the assembly comprising:

a pair of axis-defining, coaxial, and axially spaced journals;

respective roll supports carried in the journals and rotatable therein about the axis, the roll supports each being formed with a pair of radially spaced and separate annular surfaces both centered on the axis, the surfaces of one support being directed at least generally axially toward the other roll support, at least one of the surfaces of each pair being substantially frustoconical and forming with the axis a different angle from the other of the surfaces of the pair, one of the supports being formed at the axis with an axially extending passage;

a roll ring centered on the axis and having generally axially oppositely directed pairs of annular surfaces respectively complementary to and flatly engaging the annular surfaces of the roll supports; and means including an extension axially fixed to the other of the supports and extending with radial play through the passage for pulling the two supports axially toward each other and thereby axially compressing the roll ring between the annular surfaces of the roll supports.

2. The roll assembly defined in claim 1 wherein each surface pair includes an inner surface relatively close to the axis and an outer surface relative far from the axis, the inner surface forming with the axis a smaller angle than the respective outer surface.

3. The roll assembly defined in claim 2 wherein the inner surface forms an angle of about 0° to the axis and the outer surface an angle of about 90°.

4. The roll assembly defined in claim 2 wherein the outer surface extends to the outer periphery of the respective support.

5. The roll assembly defined in claim 2 wherein the outer surface of each support has an apex angle open toward the other support.

6. The roll assembly defined in claim 5 wherein the supports are formed with relatively narrow flanges forming the outer surfaces and the means axially draws the supports together with sufficient force that these flanges are elastically deflected away from each other.

7. The roll assembly defined in claim 6 wherein the angle of the inner surfaces is and the dimensions of the supports are such that the inner surfaces engage one another only after the outer surfaces engage and the flanges deform.

8. The roll assembly defined in claim 1, further comprising axially interengaging coupling formations on the supports.

9. The roll assembly defined in claim 8 wherein the coupling formations are provided axially between the supports and radially within the ring.

10. The roll assembly defined in claim 9, further comprising a coupling sleeve formed at its end with coupling formations axially engaged in the coupling formations of the supports.

11. The roll assembly defined in claim 1, further comprising a nut on the extension constituting part of the means; and a sleeve separate from the one support and braced axially between the nut and the one support.

12. The roll assembly defined in claim 1, further comprising an annular disk carried on each support and forming the respective surfaces.

13. The roll assembly defined in claim 1, further comprising spacer rings between the surfaces of the roll ring and the surfaces of the supports.

14. The roll assembly defined in claim 1 wherein the extension is a stem axially traversing with play both supports and is provided at each end with a nut constituting part of the means, the nuts being sufficiently tightened to radially swell the respective supports and seize same tightly in the respective journals.

15. The roll assembly defined in claim 14 wherein the stem is formed with conical threads carrying the nuts.

* * * * *